US007549851B2

(12) United States Patent
Masuda

(10) Patent No.: US 7,549,851 B2
(45) Date of Patent: Jun. 23, 2009

(54) ROTARY FLUID MACHINE HAVING A PAIR OF ROTATION MECHANISMS AND A PARTITION PLATE DISPOSED BETWEEN THE ROTATION MECHANISMS

(75) Inventor: Masanori Masuda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 433 days.

(21) Appl. No.: 10/571,791

(22) PCT Filed: May 11, 2005

(86) PCT No.: PCT/JP2005/008636

§ 371 (c)(1),
(2), (4) Date: Mar. 15, 2006

(87) PCT Pub. No.: WO2005/108795

PCT Pub. Date: Nov. 17, 2005

(65) Prior Publication Data

US 2008/0240958 A1 Oct. 2, 2008

(30) Foreign Application Priority Data

May 11, 2004 (JP) ..... 2004-140696

(51) Int. Cl.
*F03C 2/00* (2006.01)
*F04C 18/00* (2006.01)
*F04C 2/00* (2006.01)

(52) U.S. Cl. ..... 418/59; 418/57

(58) Field of Classification Search ..... 418/5, 418/7, 8, 9, 57, 59, 61.1
See application file for complete search history.

(56) References Cited

U.S. PATENT DOCUMENTS

| | | | | |
|---|---|---|---|---|
| 300,628 | A * | 6/1884 | Nash | 418/59 |
| 453,641 | A * | 6/1891 | Johnson | 418/59 |
| 2,966,898 | A * | 1/1961 | Jacobs et al. | 418/59 |
| 3,125,031 | A * | 3/1964 | Rydberg et al. | 418/59 |
| 3,782,865 | A * | 1/1974 | Braun | 418/59 |
| 4,990,071 | A | 2/1991 | Sugimoto | |
| 5,399,076 | A | 3/1995 | Matsuda et al. | |
| 2003/0194340 | A1 | 10/2003 | Ni | |
| 2005/0031465 | A1 | 2/2005 | Dreiman | |

FOREIGN PATENT DOCUMENTS

| | | | |
|---|---|---|---|
| CN | 1143061 C | | 3/2004 |
| JP | 51-023371 | * | 4/1970 |
| JP | 59-041602 A | | 3/1984 |
| JP | 59-113289 A | | 6/1984 |

(Continued)

*Primary Examiner*—Theresa Trieu
(74) *Attorney, Agent, or Firm*—Global IP Counselors

(57) ABSTRACT

A rotary fluid machine includes a first rotation mechanism and a second rotation mechanism. Each of them includes a cylinder having a cylinder chamber and an annular piston which is contained in the cylinder chamber and divides the cylinder chamber into an outer working chamber and an inner working chamber. The cylinder rotates around the piston. The first rotation mechanism and the second rotation mechanism are arranged to be adjacent to each other with a partition plate sandwiched therebetween. The cylinder of the first rotation mechanism and the cylinder of the second rotation mechanism are arranged such that one of the cylinders is provided at one side of a partition plate and the other is provided at the other side of the partition plate. Each of the first rotation mechanism and the second rotation mechanism is provided with a compliance mechanism for reducing a gap that occurs between the cylinders in the axial direction of the drive shaft.

17 Claims, 7 Drawing Sheets

FOREIGN PATENT DOCUMENTS

| | | | |
|---|---|---|---|
| JP | 60-90584 | U | 6/1985 |
| JP | 61-151090 | U | 9/1986 |
| JP | 62-138802 | U | 9/1987 |
| JP | 63-60091 | U | 4/1988 |
| JP | 02-037192 | A | 2/1990 |
| JP | 06-159278 | A | 6/1994 |
| JP | 06-288358 | A | 10/1994 |
| JP | 08-128395 | A | 5/1996 |
| JP | 09-004575 | A | 1/1997 |
| JP | 2000-104677 | A | 4/2000 |
| JP | 2005-054803 | A | 3/2005 |
| WO | WO-00/65236 | A1 | 11/2000 |
| WO | WO-02-088529 | A1 | 11/2002 |
| WO | WO-03-087540 | A1 | 10/2003 |

* cited by examiner

ROTARY FLUID MACHINE HAVING A PAIR OF ROTATION MECHANISMS AND A PARTITION PLATE DISPOSED BETWEEN THE ROTATION MECHANISMS

CROSS-REFERENCE TO RELATED APPLICATIONS

This U.S. National stage application claims priority under 35 U.S.C. §119(a) to Japanese Patent Application No. 2004-140696, filed in Japan on May 11, 2004 the entire contents of which are hereby incorporated herein by reference.

TECHNICAL FIELD

The present invention relates to a rotary fluid machine, particularly to measures for controlling force exerted in the axial direction.

BACKGROUND ART

As a conventional example of a fluid machine, Patent Publication 1 discloses a compressor having an eccentric rotation piston mechanism achieved by a cylinder having an annular cylinder chamber and an annular piston which is contained in the cylinder chamber to make eccentric rotation. The fluid machine compresses a refrigerant by making use of volumetric change in the cylinder chamber caused by the eccentric rotation of the piston. See, for example. Japanese Patent Publication No. 06-288358.

SUMMARY OF THE INVENTION

The conventional fluid machine has only a single piston mechanism which is connected to a motor. Therefore, it has been required a component for receiving fluid pressure applied in the axial direction of a drive shaft. More specifically, the piston in the conventional fluid machine is pressed by the cylinder due to the compressed fluid pressure. As a result, a large slide loss occurs between the piston and cylinder, thereby impairing the efficiency.

In light of the above, the present invention has been achieved. An object of the present invention is to reduce the fluid pressure in the axial direction to reduce the slide loss, thereby improving the efficiency.

As shown in FIG. 1, a first aspect of the present invention includes a first rotation mechanism (2F) and a second rotation mechanism (2S), each of which including: a cylinder (21) having an annular cylinder chamber (50); an annular piston (22) which is contained in the cylinder chamber (50) to be eccentric to the cylinder (21) and divides the cylinder chamber (50) into an outer working chamber (51) and an inner working chamber (52); and a blade (23) which is arranged in the cylinder chamber (50) to divide each of the working chambers (51, 52) into a high pressure region and a low pressure region, the piston (22) and the cylinder (21) serving as co-operating parts and any one of the piston (22) and the cylinder (21) being stationary and the other being moving such that the moving part rotates about the stationary part. The first rotation mechanism (2F) and the second rotation mechanism (2S) are arranged to be adjacent to each other with a partition plate (2*c*) sandwiched therebetween and the two moving parts or the two stationary parts of the first rotation mechanism (2F) and the second rotation mechanism (2S) are arranged such that one of the co-operating parts is provided at one side of the partition plate (2*c*) and the other is provided at the other side of the partition plate (2*c*).

According to the first aspect of the present invention, when the first and second rotation mechanisms (2F) and (2S) are actuated, the moving parts (21) of the co-operating parts rotate relative to the stationary parts (22) of the co-operating parts to change the volumes of the working chambers (51, 52). Thus, a fluid is compressed or expanded.

According to a second aspect of the present invention related to the first aspect of the present invention, the inner working chambers (52) of the cylinder chambers (50) of the first rotation mechanism (2F) and the second rotation mechanism (2S) serve as a low-stage compression chambers and the outer working chambers (51) of the cylinder chambers (50) of the first rotation mechanism (2F) and the second rotation mechanism (2S) serve as high-stage compression chambers.

According to the second aspect of the present invention, a fluid is compressed in two stages in the first rotation mechanism (2F) and the second rotation mechanism (2S).

According to a third aspect of the present invention related to the first aspect of the present invention, the outer working chambers (51) of the cylinder chambers (50) of the first rotation mechanism (2F) and the second rotation mechanism (2S) serve as compression chambers and the inner working chambers (52) of the cylinder chambers (50) of the first rotation mechanism (2F) and the second rotation mechanism (2S) serve as expansion chambers.

According to the third aspect of the present invention, compression and expansion of a fluid are carried out in the first rotation mechanism (2F) and the second rotation mechanism (2S).

According to a fourth aspect of the present invention related to the first aspect of the present invention, the partition plate (2*c*) serves as the end plates (26) of the co-operating parts (21) of the first rotation mechanism (2F) and the second rotation mechanism (2S).

According to a fifth aspect of the present invention related to the first aspect of the present invention, the co-operating part (21) of the first rotation mechanism (2F) and the co operating part (21) of the second rotation mechanism (2S) adjacent to the first rotation mechanism (2F) have individual end plates (26) and the partition plate (2*c*) is formed of the end plates (26) of the co-operating parts (21) of the first and second rotation mechanisms (2F, 2S).

According to a sixth aspect of the present invention related to the first aspect of the present invention, the moving co-operating parts (21) of the first and second rotation mechanisms (2F, 2S) are connected to a drive shaft (33) and each of the first rotation mechanism (2F) and the second rotation mechanism (2S) is provided with a compliance mechanism (60) for adjusting the position of the co-operating parts (21, 22) in the axial direction of the drive shaft (33).

In the sixth aspect of the present invention, leakage from the ends of the co-operating parts (21) is prevented by the axial compliance mechanism (60).

According to a seventh aspect of the present invention related to the first aspect of the present invention, the moving co-operating parts (21) of the first and second rotation mechanisms (2F, 2S) are connected to a drive shaft (33) and each of the first rotation mechanism (2F) and the second rotation mechanism (2S) is provided with a compliance mechanism (60) for adjusting the position of the co-operating parts (21) in the direction orthogonal to the axial direction of the drive shaft (33).

In the seventh aspect of the present invention, gaps that occur between the co-operating parts (21) in the radius direction are reduced to a minimum, respectively, by the compliance mechanism (60) for adjustment in the orthogonal direction.

According to an eighth aspect of the present invention related to the first aspect of the present invention, the moving parts (21) of the co-operating parts of the first and second rotation mechanisms (2F, 2S) are connected to a drive shaft (33) and a balance weight (75) is provided at part of the drive shaft (33) located between the end plates (26) of the co-operating parts of the first rotation mechanism (2F) and the second rotation mechanism (2S) adjacent to each other.

In the eighth aspect of the present invention, the balance weight (75) eliminates imbalance caused by the rotation of the co-operating parts (21).

According to a ninth aspect of the present invention related to the first aspect of the present invention, the first rotation mechanism (2F) and the second rotation mechanism (2S) are configured to rotate with a 90° phase difference from each other.

In the ninth aspect of the present invention, discharge occurs four times while the drive shaft (33) makes a single rotation. Therefore, torque fluctuations are reduced.

According to a tenth aspect of the present invention related to the first aspect of the present invention, in each of the first and second rotation mechanisms (2F, 2S), part of the annular piston (22) is cut off such that the piston (22) is C-shaped, the blade (23) extends from the inner wall surface to the outer wall surface of the cylinder chamber (50) and passes through the cut-off portion of the piston (22) and a swing bushing is provided in the cut-off portion of the piston (22) to contact the piston (22) and the blade (23) via the surfaces thereof such that the blade (23) freely reciprocates and the blade (23) and the piston (22) make relative swings.

In the tenth aspect of the present invention, the blade (23) reciprocates through the swing bushing (27) and the blade (23) swings together with the swing bushing (27) relative to the piston (22). Accordingly, the cylinder (21) and the piston (22) make relative swings and rotations, whereby the rotation mechanisms (2F, 2S) achieve predetermined work such as compression.

Thus, according to the present invention, the working chambers (51, 52) are provided in both of the two rotation mechanisms (2F, 2S) with the end plates (26) of the co-operating parts (21) sandwiched therebetween. Therefore, fluid pressures exerted on the two co-operating parts (21) cancel out each other. Further, losses of the sliding parts caused by the rotation of the co-operating parts (21) are reduced, thereby improving the efficiency.

According to the fourth aspect of the present invention, the end plates (26) of the co-operating parts (21) of the first and second rotation mechanisms (2F) and (2S) are integrated. Therefore, the co-operating parts (21) are prevented from leaning (overturning). This allows smooth movement of the co-operating parts (21).

According to the fifth aspect of the present invention, the cylinder (21) of the first rotation mechanism (2F) and the co-operating part (21) of the second rotation mechanism (2S) are separated. Therefore, thrust losses do not occur and the co-operating parts (21) are moved separately.

According to the sixth aspect of the present invention, leakage from the ends of the co-operating parts (21, 22) is surely prevented because the axial compliance mechanism (60) is provided. In particular, as the two rotation mechanisms (2F, 2S) are provided, the compliance mechanism (60) is simplified and the gaps between the ends of the co-operating parts (21, 22) are reduced.

According to the seventh aspect of the present invention, the compliance mechanism (60) for adjustment in the direction orthogonal to the drive shaft (33) is provided. Therefore, the co-operating parts (21) of the first and second rotation mechanisms (2F, 2S) move in the radius direction, thereby adjusting the gaps between the co-operating parts (21) in the radius direction separately. As a result, thrust losses do not occur and the gaps between the co-operating parts (21) in the radius direction are reduced.

According to the eighth aspect of the present invention, the balance weight (75) is used. Therefore, the imbalance caused by the rotation of the co-operating parts (21) is eliminated.

Further, since the balance weight (75) is provided between the first and second rotation mechanisms (2F, 2S), the drive shaft (33) is prevented from flexure.

According to the ninth aspect of the present invention, since the first and second rotation mechanisms (2F, 2S) rotate with a 90° phase difference from each other, discharge occurs four times as the drive shaft (33) makes a single rotation. Therefore, the torque fluctuations are significantly reduced.

According to the tenth aspect of the present invention, the swing bushing (27) is provided as a connector for connecting the piston (22) and the blade (23) such that the swing bushing (27) substantially contacts the piston (22) and the blade (23) via the surfaces thereof. Therefore, the piston (22) and the blade (23) are prevented from wearing away and seizing up at the contacting parts during operation.

Moreover, as the blade (23) is configured as an integral part of the cylinder (21) and supported by the cylinder (21) at both ends thereof, the blade (23) is less likely to receive abnormal concentrated load and stress concentration is less likely to occur during operation. Therefore, the sliding parts are less prone to be damaged, thereby improving the reliability of the mechanism.

DETAILED DESCRIPTION OF THE INVENTION

Hereinafter, embodiments of the present invention will be described in detail with reference to the drawings.

First Embodiment

Figure 1:
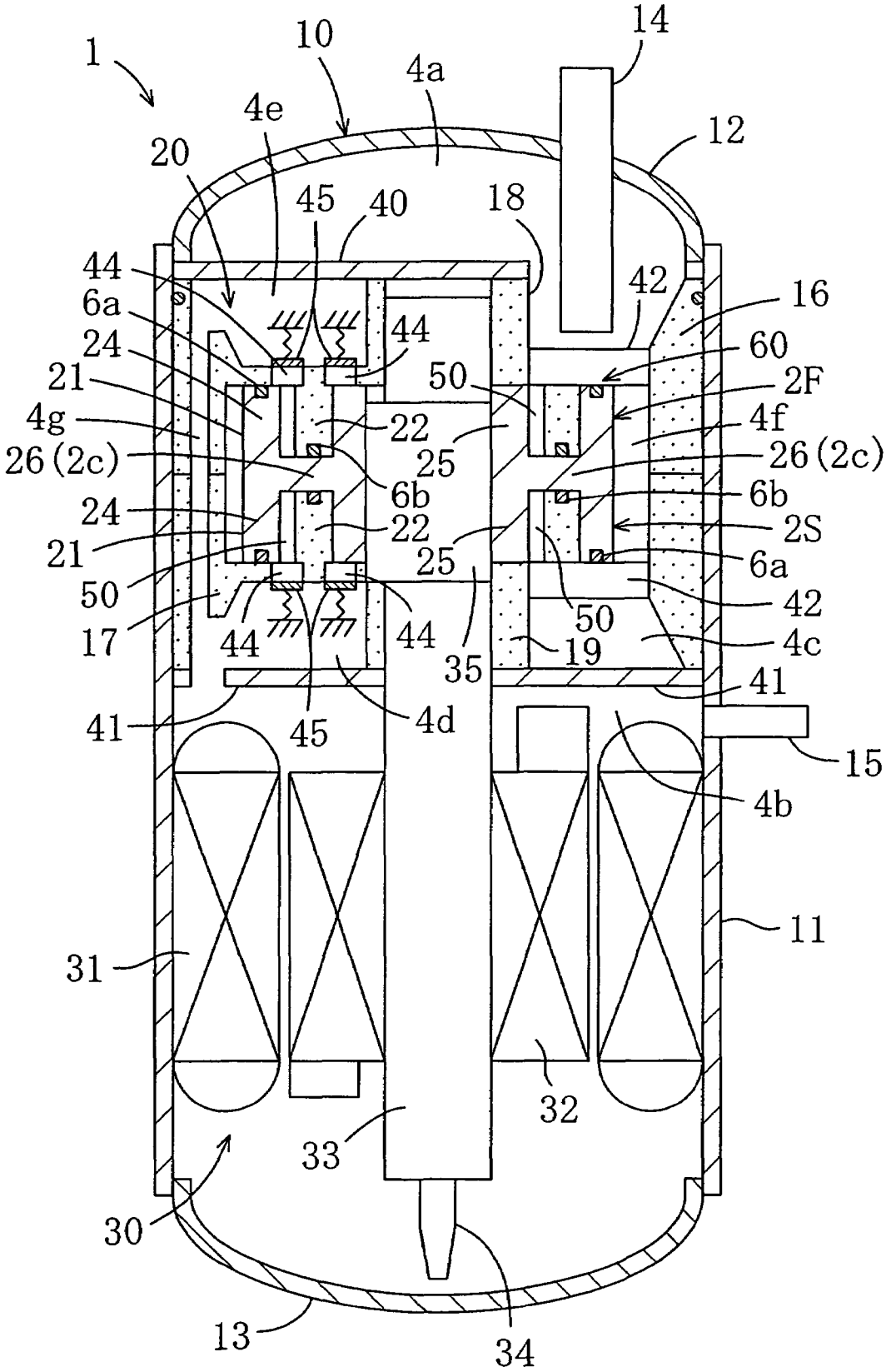
FIG. 1 is a vertical cross section of a compressor according to a first embodiment of the present invention.
Figure 2:
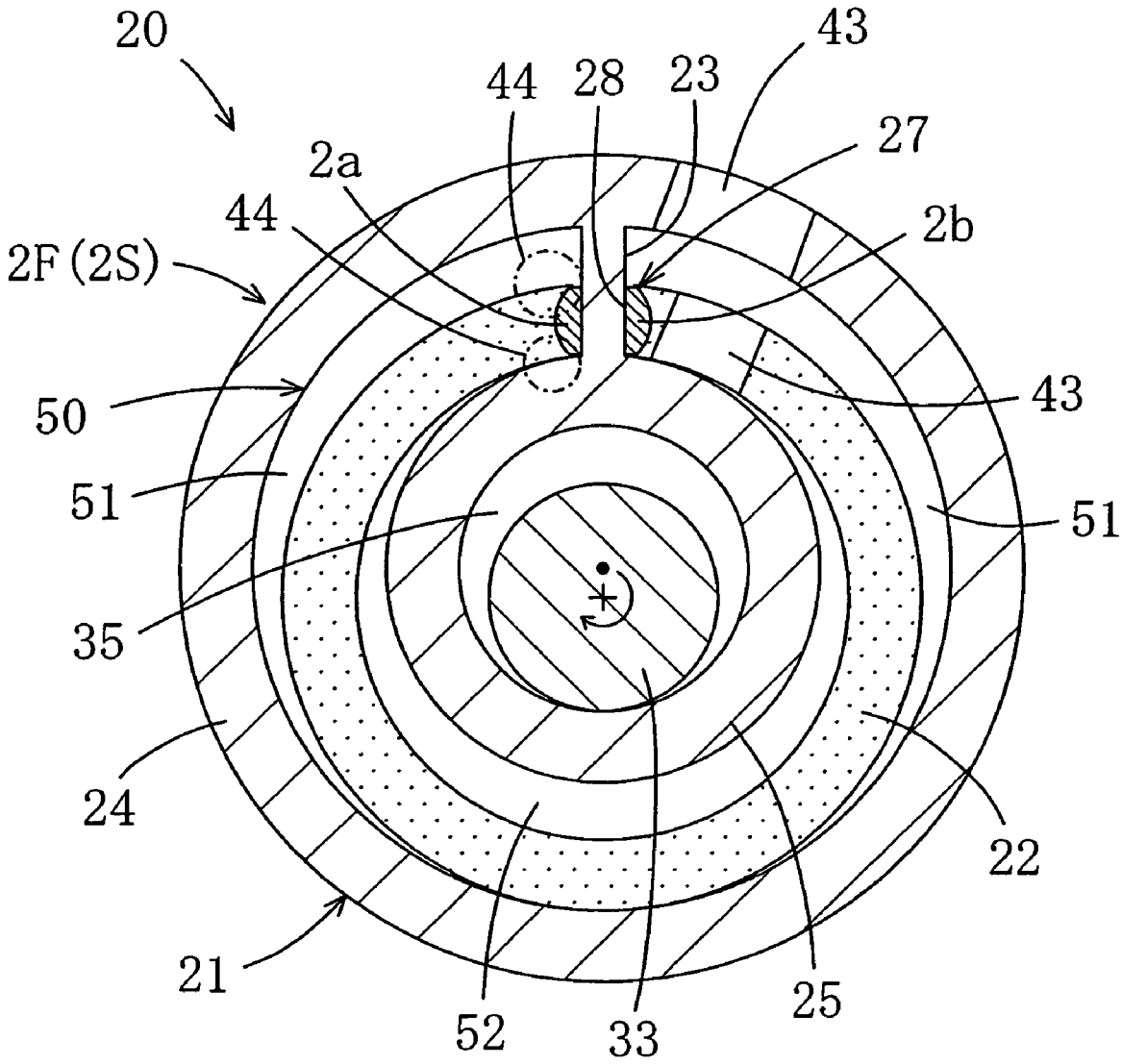
FIG. 2 is a horizontal cross section of a compressor mechanism.

In the present embodiment, the present invention is applied to a compressor (1) as shown in FIGS. 1 to 3. The compressor (1) is provided in a refrigerant circuit, for example.

The refrigerant circuit is configured to perform at least cooling or heating. Specifically, the refrigerant circuit includes, an exterior heat exchanger serving as a heat source-side heat exchanger, an expansion valve serving as an expansion mechanism and an interior heat exchanger serving as a use-side heat exchanger which are connected in this order to the compressor (1). A refrigerant compressed by the compressor (1) releases heat in the exterior heat exchanger and expands at the expansion valve. Then, the expanded refrigerant absorbs heat in the interior heat exchanger and returns to the compressor (1). By repeating the circulation in this manner, the room air is cooled in the interior heat exchanger.

The compressor (1) is a completely hermetic rotary fluid machine including a compressor mechanism (20) and a motor (30) contained in a casing (10).

The casing (10) includes a cylindrical barrel (11), a top end plate (12) fixed to the top end of the barrel (11) and a bottom end plate (13) fixed to the bottom end of the barrel (11). A suction pipe (14) penetrates the top end plate (12) and is connected to the interior heat exchanger. A discharge pipe (15) penetrates the barrel (11) and is connected to the exterior heat exchanger.

The motor (30) is a drive mechanism and includes a stator (31) and a rotor (32). The stator (31) is arranged below the compressor mechanism (20) and fixed to the barrel (11) of the casing (10). A drive shaft (33) is connected to the rotor (32) such that the drive shaft (33) rotates together with the rotor (32).

The drive shaft (33) has a lubrication path (not shown) extending within the drive shaft (33) in the axial direction. At the bottom end of the drive shaft (33), a lubrication pump (34) is provided. The lubrication path extends upward from the lubrication pump (34) such that lubricating oil accumulated in the bottom of the casing (10) is supplied to sliding parts of the compressor mechanism (20) through the lubrication pump (34).

The drive shaft (33) includes an eccentric part (35) at the upper part thereof. The eccentric part (35) is larger in diameter than the other parts of the drive shaft above and below the eccentric part (35) and deviated from the center of the drive shaft (33) by a certain amount.

The compressor mechanism (20) is a rotation mechanism including a first rotation mechanism (2F) and a second rotation mechanism (2S). The compressor mechanism (20) is provided between a top housing (16) and a bottom housing (17) which are fixed to the casing (10). Although the first rotation mechanism (2F) and the second rotation mechanism (2S) are configured to be inverted upside down, their structures are the same. Thus, for explanation, the first rotation mechanism (2F) is taken as an example.

The first rotation mechanism (2F) includes a cylinder (21) having an annular cylinder chamber (50), an annular piston (22) which is contained in the cylinder chamber (50) and divides the cylinder chamber (50) into an outer compressor chamber (51) and an inner compressor chamber (52) and a blade (23) which divides each of the outer and inner compression chambers (51) and (52) into a high pressure region and a low pressure region as shown in FIG. 2. The piston (22) in the cylinder chamber (50) is configured such that eccentric rotations are made relative to the cylinder (21). Specifically, relative eccentric rotations are made by the piston (22) and the cylinder (21). In the first embodiment, the cylinder (21) having the cylinder chamber (50) and the piston (22) contained in the cylinder chamber (50) serve as co-operating parts and the cylinder (21) is moving and the piston (22) is stationary.

The cylinder (21) includes an outer cylinder (24) and an inner cylinder (25). The outer and inner cylinders (24) and (25) are connected in one piece at the bottom by an end plate (26). The inner cylinder (25) is slidably fitted around the eccentric part (35) of the drive shaft (33). That is, the drive shaft (33) penetrates the cylinder chamber (50) in the vertical direction.

The piston (22) is integrated with the top housing (16). The top and bottom housings (16) and (17) are provided with bearings (18) and (19) for supporting the drive shaft (33), respectively. Thus, in the compressor (1) of the present embodiment, the drive shaft (33) penetrates the cylinder chamber (50) in the vertical direction and parts of the drive shaft sandwiching the eccentric part (35) in the axial direction are supported by the casing (10) via the bearings (18) and (19).

The first rotation mechanism (2F) includes a swing bushing (27) for connecting the piston (22) and the blade (23) in a movable manner. The piston (22) is in the form of a ring partially cut off, i.e., C-shaped. The blade (23) is configured to extend from the inner wall surface to the outer wall surface of the cylinder chamber (50) in the direction of the radius of the cylinder chamber (50) to pass through the cut-off portion of the piston (22) and fixed to the outer and inner cylinders (24) and (25). The swing bushing (27) serves as a connector for connecting the piston (22) and the blade (23) at the cut-off portion of the piston (22).

The inner circumference surface of the outer cylinder (24) and the outer circumference surface of the inner cylinder (25) are surfaces of concentric cylinders, respectively, and a single cylinder chamber (50) is formed between them. The outer circumference of the piston (22) yields a smaller diameter than the diameter given by the inner circumference of the outer cylinder (24), while the inner circumference of the piston (22) yields a larger diameter than the diameter given by the outer circumference of the inner cylinder (25). According to the structure, an outer compression chamber (51) as a working chamber is formed between the outer circumference surface of the piston (22) and the inner circumference surface of the outer cylinder (24) and an inner compression chamber (52) as a working chamber is formed between the inner circumference surface of the piston (22) and the outer circumference surface of the inner cylinder (25).

When the outer circumference surface of the piston (22) and the inner circumference surface of the outer cylinder (24) are substantially in contact with each other at a certain point (there is a micron-order gap between them in a strict sense, but refrigerant leakage from the gap is negligible), the inner circumference surface of the piston (22) and the outer circumference surface of the inner cylinder (25) come into contact with each other at a point having a phase 180° different from the certain point.

The swing bushing (27) includes a discharge-side bushing (2*a*) which is positioned closer to the discharge side than the blade (23) and a suction-side bushing (2*b*) which is positioned closer to the suction side than the blade (23). The discharge-side bushing (2*a*) and the suction-side bushing (2*b*) are in the same semicircle shape when viewed in section and arranged such that their flat surfaces face each other. Space between the discharge-side bushing (2*a*) and the suction-side bushing (2*b*) serves as a blade slit (28).

The blade (23) is inserted into the blade slit (28). The flat surfaces of the swing bushing (27) are substantially in contact with the blade (23). The arc-shaped outer circumference surfaces of the swing bushing (27) are substantially in contact with the piston (22). The swing bushing (27) is configured such that the blade (23) inserted in the blade slit (28) reciprocates in the direction of its surface within the blade slit (28). Further, the swing bushing (27) is configured to swing together with the blade (23) relative to the piston (22). Therefore, the swing bushing (27) is configured such that the blade (23) and the piston (22) can make relative swings at the center of the swing bushing (27) and the blade (23) can reciprocate relative to the piston (22) in the direction of the surface of the blade (23).

In the present embodiment, the discharge-side bushing (2*a*) and the suction-side bushing (2*b*) are separated. However, the bushings (2*a*) and (2*b*) may be connected at any part in one piece.

In the above-described structure, when the drive shaft (33) rotates, the blade (23) reciprocates within the blade slit (28) and the outer cylinder (24) and the inner cylinder (25) swing at the center of the swing bushing (27). According to the swing movement, the contact point between the piston (22) and the cylinder (21) is shifted in the order shown in FIGS. 3A to 3D. At this time, the outer and inner cylinders (24) and (25) go around about the drive shaft (33) but do not spin by themselves.

The outer compressor chamber (51) outside the piston (22) decreases in volume in the order shown in FIGS. 3C, 3D, 3A and 3B. The inner compressor chamber (52) inside the piston (22) decreases in volume in the order shown in FIGS. 3A, 3B, 3C and 3D.

The second rotation mechanism (2S) is inverted upside down from the first rotation mechanism (2F) and the piston (22) therein is integrated with the bottom housing (17). Specifically, the piston (22) of the first rotation mechanism (2F) and the piston (22) of the second rotation mechanism (2S) are inverted upside down.

The cylinder (21) of the second rotation mechanism (2S) includes an outer cylinder (24) and an inner cylinder (25). The outer and inner cylinders (24) and (25) are connected in one piece at the top by an end plate (26). The inner cylinder (25) is slidably fitted around the eccentric part (35) of the drive shaft (33).

The cylinder (21) of the first rotation mechanism (2F) and the cylinder (21) of the second rotation mechanism (2S) are integrated. Further, the end plate (26) of the cylinder (21) of the first rotation mechanism (2F) and the end plate (26) of the cylinder (21) of the second rotation mechanism (2S) provide a single partition plate (2*c*). Specifically, the partition plate (2*c*) serves as the end plate (26) of the cylinder (21) of the first rotation mechanism (2F) and the end plate (26) of the cylinder (21) of the second rotation mechanism (2S). The cylinder (21) of the first rotation mechanism (2F) is provided at one of the sides of the partition plate (2*c*), while the cylinder (21) of the second rotation mechanism (2S) is provided at the other side of the partition plate (2*c*).

A top cover plate (40) is provided on the top housing (16) and a bottom cover plate (41) is provided below the bottom housing (17). In the casing (10), space above the top cover plate (40) is defined as suction space (4*a*) and space below the bottom cover plate (41) is defined as discharge space (4*b*). An end of the suction pipe (14) is opened in the suction space (4*a*) and an end of the discharge pipe (15) is opened in the discharge space (4*b*).

A first chamber (4*c*) and a second chamber (4*d*) are formed between the bottom housing (17) and the bottom cover plate (41). Further, a third chamber (4*e*) is formed between the top housing (16) and the top cover plate (40). Each of the top housing (16) and the bottom housing (17) has a vertical hole (42) which penetrates the top housing (16) or the bottom housing (17) in the axial direction. Each of the vertical holes (42) is elongated in shape in the radius direction. Between the top housing (16) and the bottom housing (17), a pocket (4*f*) is formed along the outer circumference surface of the outer cylinder (24). The pocket (4*f*) communicates with the suction space (4*a*) through the vertical hole (42) of the top housing (16) to keep the pressure in the atmosphere of the pocket (4*f*) at a low suction pressure. Further, the pocket (4*f*) communicates with the first chamber (4*c*) through the vertical hole (42) of the bottom cover plate (41) to keep the pressure in the atmosphere of the first chamber (4*c*) at a low suction pressure.

Referring to FIGS. 1 and 2, the vertical holes (42) of the top housing (16) and the bottom housing (17) illustrated in FIG. 1 are positioned at the right of the blade (23) shown in FIG. 2. Through the vertical holes (42) which are opened to the outer and inner compression chambers (51) and (52), the outer and inner compression chambers (51) and (52) communicate with the suction space (4*a*).

The outer cylinder (24) and the piston (22) have horizontal holes (43) penetrating in the radius direction, respectively. Referring to FIG. 2, the horizontal holes (43) are positioned at the right of the blade (23). The outer compression chamber (51) and the pocket (4*f*) communicate with each other through the horizontal hole (43) of the outer cylinder (24), whereby the outer compression chamber (51) communicates with the suction space (4*a*). Further, the inner compression chamber (52) and the outer compression chamber (51) communicate with each other through the horizontal hole (43) of the piston (22), whereby the inner compression chamber (52) communicates with the suction space (4*a*). The vertical hole (42) and the horizontal holes (43) serve as suction ports for a refrigerant. Only one of the vertical hole (42) and the horizontal holes (43) may be formed as the refrigerant suction port.

The top housing (16) has discharge ports (44) and the bottom housing (17) also has discharge ports (44). The discharge ports (44) penetrate the top housing (16) or the bottom housing (17) in the axial direction. In each of the top and bottom housings (16) and (17), one of the two discharge ports (44) faces the high pressure region of the outer compressor chamber (51) at one end and the other discharge port (44) faces the high pressure region of the inner compressor chamber (52) at one end. Specifically, the discharge ports (44) are formed near the blade (23) and positioned opposite to the vertical hole (42) relative to the blade (23). The other ends of the discharge ports (44) communicate with the second chamber (4*d*) or the third chamber (4*e*). At the outside ends of the discharge ports (44), discharge valves (45) are provided as reed valves for opening/closing the discharge ports (44).

The second chamber (4*d*) and the third chamber (4*e*) communicate with each other through a discharge path (4*g*) formed in the top and bottom housings (16) and (17). The second chamber (4*d*) thus communicates with the discharge space (4*b*).

Seal rings (6*a*, 6*b*) are provided at the end faces of the outer cylinder (24) and the piston (22). The seal rings (6*a*) at the outer cylinder (24) are pressed toward the top housing (16) and the bottom housing (17), respectively, and the seal rings (6*b*) at the piston (22) are pressed toward the end plate (26) of the cylinder (21). With this structure, the seal rings (6*a*, 6*b*) serve as a compliance mechanism (60) for adjusting the position of the cylinder (21) in the axial direction, thereby reducing the gaps that occur in the axial direction between the piston (22), cylinder (21), top housing (16) and bottom housing (17).

-Operation-

Next, an explanation of how the compressor (1) works is provided.

When the motor (30) is actuated, the rotation of the rotor (32) is transferred to the outer and inner cylinders (24) and (25) of the first rotation mechanism (2F) and the outer and inner cylinders (24) and (25) of the second rotation mechanism (2S) via the drive shaft (33). Then, in each of the first and second rotation mechanisms (2F) and (2S), the blade (23) reciprocates through the swing bushing (27), while the blade (23) and the swing bushing (27) swing together relative to the piston (22). As a result, the outer and inner cylinders (24) and (25) swing and rotate relative to the piston (22). The first and second rotation mechanisms (2F) and (2S) thus perform compression as required.

Figure 3A:
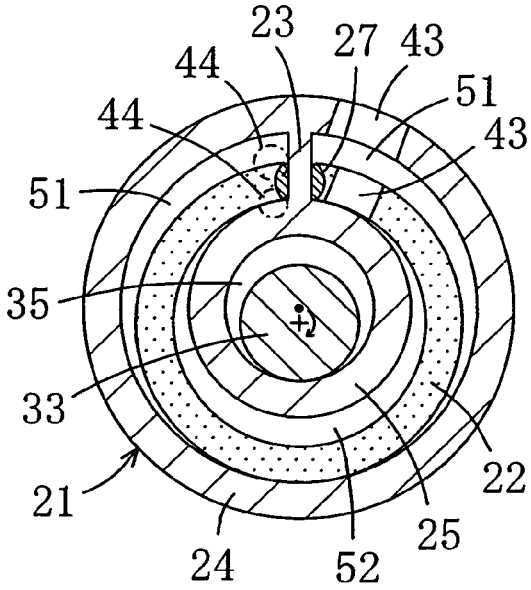
FIGS. 3A to 3D are horizontal cross sections illustrating how the compressor mechanism works.
Figure 3D:
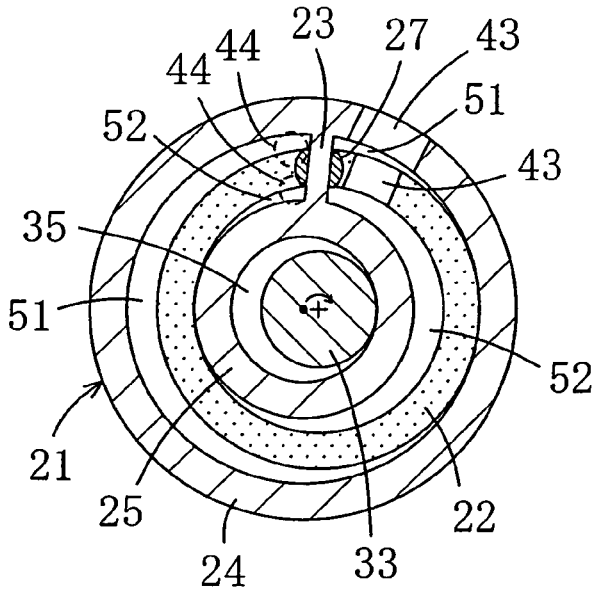
Figure 3B:
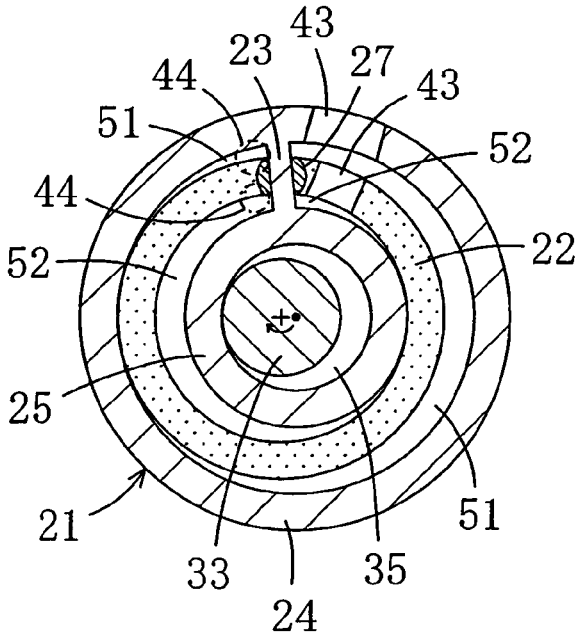
Figure 3C:
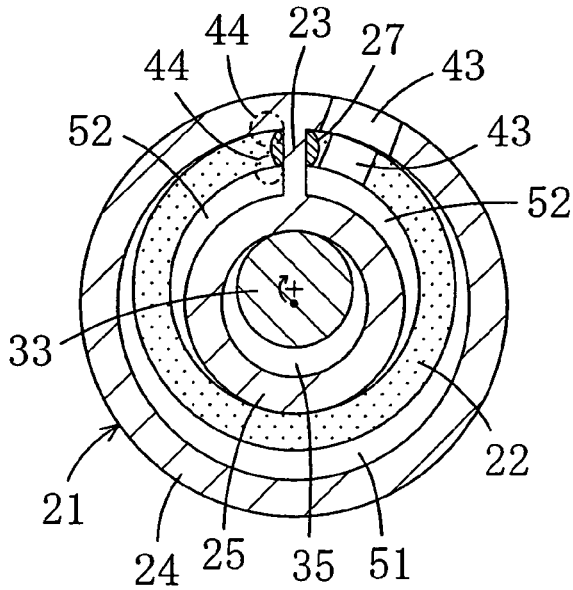

Specifically, in the first rotation mechanism (2F), when the drive shaft (33) rotates to the right while the piston (22) is at the top dead center as shown in FIG. 3C, suction starts in the outer compression chamber (51). As the state of the first rotation mechanism (2F) changes in the order shown in FIGS. 3D, 3A and 3B, the outer compressor chamber (51) increases in volume and the refrigerant is sucked therein through the vertical hole (42) and the horizontal holes (43).

When the piston (22) is at the top dead center as shown in FIG. 3C, the outer compressor chamber (51) forms a single chamber outside the piston (22). In this state, the volume of the outer compressor chamber (51) is substantially the maximum. Then, as the drive shaft (33) rotates to the right to change the state of the first rotation mechanism (2F) in the order shown in FIGS. 3D, 3A and 3B, the outer compressor chamber (51) decreases in volume and the refrigerant therein is compressed. When the pressure in the outer compressor chamber (51) reaches a predetermined value and the differential pressure between the outer compressor chamber (51) and the discharge space (4*b*) reaches a specified value, the discharge valves (45) are opened by the high pressure refrigerant in the outer compressor chamber (51). Thus, the high pressure refrigerant is released from the discharge space (4*b*) into the discharge pipe (15).

In the inner compressor chamber (52), suction starts when the drive shaft (33) rotates to the right from the state where the piston (22) is at the bottom dead center as shown in FIG. 3A. As the state of the first rotation mechanism (2F) changes in the order shown in FIGS. 3B, 3C and 3D, the inner compressor chamber (52) increases in volume and the refrigerant is sucked therein through the vertical hole (42) and the horizontal holes (43).

When the piston (22) is at the bottom dead center as shown in FIG. 3A, the inner compressor chamber (51) forms a single chamber inside the piston (22). In this state, the volume of the inner compressor chamber (52) is substantially the maximum. Then, as the drive shaft (33) rotates to the right to change the state of the first rotation mechanism (2F) in the order shown in FIGS. 3B, 3C and 3D, the inner compressor chamber (52) decreases in volume and the refrigerant therein is compressed. When the pressure in the inner compressor chamber (52) reaches a predetermined value and the differential pressure between the inner compressor chamber (52) and the discharge space (4*b*) reaches a specified value, the discharge valves (45) are opened by the high pressure refrigerant in the inner compressor chamber (52). Thus, the high pressure refrigerant is released from the discharge space (4*b*) into the discharge pipe (15).

The same compression occurs also in the second rotation mechanism (2S) as in the first rotation mechanism (2F) and the high pressure refrigerant is released from the discharge space (4*b*) into the discharge pipe (15).

The high pressure refrigerant compressed in the outer compression chambers (51) and the inner compression chambers (52) of the first and second rotation mechanisms (2F) and (2S) is condensed in the exterior heat exchanger. The condensed refrigerant expands at the expansion valve and evaporates in the interior heat exchanger. Then, the low pressure refrigerant returns to the outer compression chambers (51) and the inner compression chambers (52). The circulation occurs in this manner.

During the compression in the first and second rotation mechanisms (2F) and (2S), refrigerant pressure in the axial direction is exerted. However, the refrigerant pressure exerted in the axial direction in the first rotation mechanism (2F) and the refrigerant pressure exerted in the axial direction in the second rotation mechanism (2S) cancel out each other. Specifically, the refrigerant pressure exerted in the axial direction in the first rotation mechanism (2F) presses the cylinder (21) downward, while the refrigerant pressure exerted in the axial direction in the second rotation mechanism (2S) presses the cylinder (21) upward. As a result, the refrigerant pressures exerted on the two cylinders (21) are eliminated.

Effect of the First Embodiment

As described above, according to the first embodiment, the outer and inner compression chambers (51) and (52) are provided at both sides of the end plate (26) located between the two cylinders (21). Therefore, the refrigerant pressures exerted on the two cylinders (21) are eliminated. Thus, losses of the sliding parts due to the rotation of the cylinders (21) are reduced, thereby improving the efficiency.

As the end plates (26) of the cylinders (21) of the first and second rotation mechanisms (2F) and (2S) are integrated, the cylinder (21) is prevented from leaning (overturning). This allows smooth movement of the cylinders (21).

Further, leakage from the ends of the cylinder (21) and the ends of the pistons (22) is surely prevented because the axial compliance mechanism (60) is provided. In particular, as the two rotation mechanisms (2F, 2S) are provided, the compliance mechanism (60) is simplified and the gaps between the ends of the cylinders (21) and the ends of the pistons (22) are reduced.

The swing bushing (27) is provided as a connector for connecting the piston (22) and the blade (23) such that the swing bushing (27) substantially contacts the piston (22) and the blade (23) via the surfaces thereof. Therefore, the piston (22) and the blade (23) are prevented from wearing away and seizing up at the contacting parts during operation.

As the swing bushing (27), piston (22) and blade (23) are in contact with each other via the surfaces thereof, the contacting parts are sealed with reliability. Therefore, the leakage of the refrigerant from the outer and inner compression chambers (51) and (52) are surely prevented, thereby preventing a decrease in compression efficiency.

Moreover, as the blade (23) is configured as an integral part of the cylinder (21) and supported by the cylinder (21) at both ends thereof, the blade (23) is less likely to receive abnormal concentrated load and stress concentration is less likely to occur during operation. Therefore, the sliding parts are less prone to be damaged, thereby improving the reliability of the mechanism.

Second Embodiment

Figure 4:
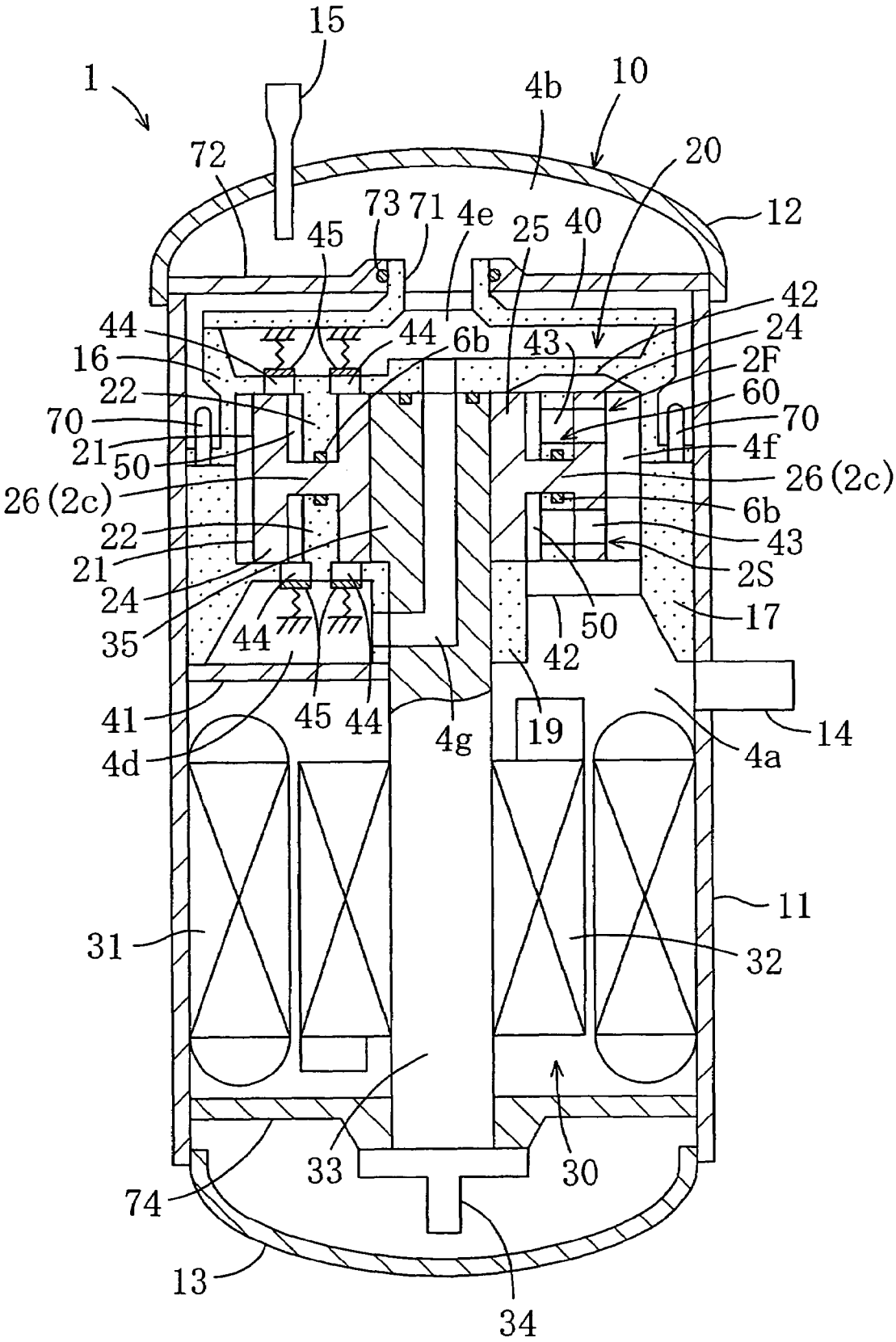
FIG. 4 is a vertical cross section of a compressor according to a second embodiment of the present invention.

Unlike the top housing (16) of the first embodiment fixed to the casing (10), the top housing (16) of the present embodiment is configured to be movable in the axial direction and space below the bottom cover plate (41) is used as the suction space (4*a*) as shown in FIG. 4.

Specifically, the top housing (16) is provided in the casing (10) to be movable in the axial (vertical) direction. The top housing (16) is fitted with pins (70) provided at the periphery of the bottom housing (17) so that it moves in the axial direction along the pins (70).

The top cover plate (40) attached to the top housing (16) has a cylindrical part (71) at the center thereof. The cylindrical part (71) is movably inserted into a center opening in a support plate (72). The support plate (72) is disc-shaped and attached to the casing (10) at the periphery thereof. With this structure, a compliance mechanism (60) for the axial direction is provided. A seal ring (73) is fitted around the cylindrical part (71) of the top cover plate (40) for sealing between the cylindrical part (71) and the support plate (72).

A suction pipe (14) is connected to the barrel (11) of the casing (10) and a discharge pipe (15) is connected to the end plate (12). Space below the bottom cover plate (41) serves as the suction space (4*a*) and space above the support plate (72) serves as the discharge space (4*b*).

The first chamber (4*c*) according to the first embodiment is omitted and the pocket (4*f*) between the top and bottom cover plates (40) and (41) communicates with the suction space (4*a*) through the vertical hole (42) formed in the bottom cover plate (41). The top opening of the vertical hole (42) in the top cover plate (40) is closed.

The third chamber (4*e*) between the top cover plate (40) and the top housing (16) communicates with the discharge space (4*b*) through the cylindrical part (71), while the second chamber (4*d*) between the bottom cover plate (41) and the bottom housing (17) communicates with the third chamber (4*e*) through the discharge path (4*g*) formed in the drive shaft (33).

The discharge path (4*g*) according to the first embodiment is omitted and the bottom end of the drive shaft (33) is supported by the casing (10) via a bearing (74). Specifically, the bearing (18) for the top housing (16) used in the first embodiment is omitted.

Thus, also in the present embodiment, a refrigerant is compressed in the outer compression chambers (51) and the inner compression chambers (52) of the first and second rotation mechanisms (2F) and (2S) on the rotation of the drive shaft (33). At this time, the gaps that occur in the axial direction between the piston (22), cylinder (21), top housing (16) and bottom housing (17) are adjusted to a minimum by the compliance mechanism (60). Other structural features and effects are the same as those of the first embodiment.

Third Embodiment

Figure 5:
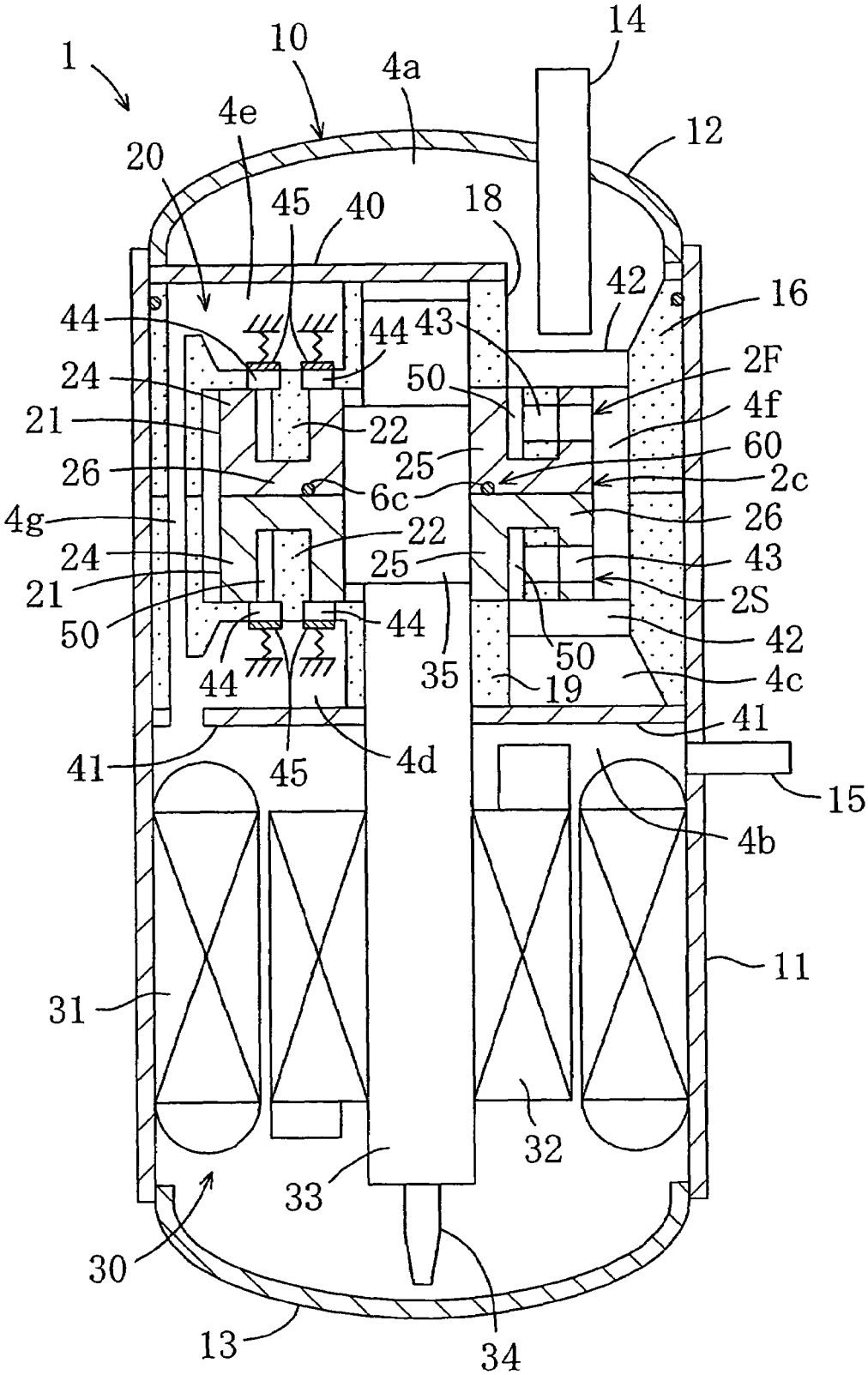
FIG. 5 is a vertical cross section of a compressor according to a third embodiment of the present invention.

Unlike the first embodiment in which the cylinders (21) of the first and second rotation mechanisms (2F) and (2S) are integrated, the cylinders (21) of the first and second rotation mechanisms (2F) and (2S) according to the present embodiment are separated as shown in FIG. 5.

The cylinder (21) of the first rotation mechanism (2F) includes an outer cylinder (24) and an inner cylinder (25) which are connected by an end plate (26). The cylinder (21) of the second rotation mechanism (2S) includes, in the same manner as the first rotation mechanism (2F), an outer cylinder (24) and an inner cylinder (25) which are connected by an end plate (26). One side of the end plate (26) of the cylinder (21) of the first rotation mechanism (2F) slidably contacts one side of the end plate (26) of the cylinder (21) of the second rotation mechanism (2S).

The end plates (26) of the first and second rotation mechanisms (2F) and (2S) serve as a partition plate (2*c*). A seal ring (6*c*) is provided between the end plates (26). The seal ring (6*c*) serves as a compliance mechanism (60) for the axial direction and the radius direction orthogonal to the axial direction.

Specifically, as the cylinders (21) of the first and second rotation mechanisms (2F) and (2S) move in the radius direction, respectively, the gaps between the cylinders (21) in the radius direction are individually adjusted to a minimum. As a result, thrust losses do not occur, thereby reducing the gaps between the cylinders (21) in the radius direction. At this time, space between the end plates (26) of the first and second rotation mechanisms (2F) and (2S) are set to a low suction pressure or an intermediate pressure between the low suction pressure and the high discharge pressure.

Since the cylinder (21) of the first rotation mechanism (2F) and the cylinder (21) of the second rotation mechanism (2S) are separated, the thrust losses do not occur and the cylinders move separately. Other structural features and effects are the same as those of the first embodiment.

If the pressure between the end plates (26) of the first and second rotation mechanisms (2F) and (2S) are set to a high discharge pressure, the refrigerant pressures exerted on the cylinders (21) do not cancel out each other.

Fourth Embodiment

Figure 6:
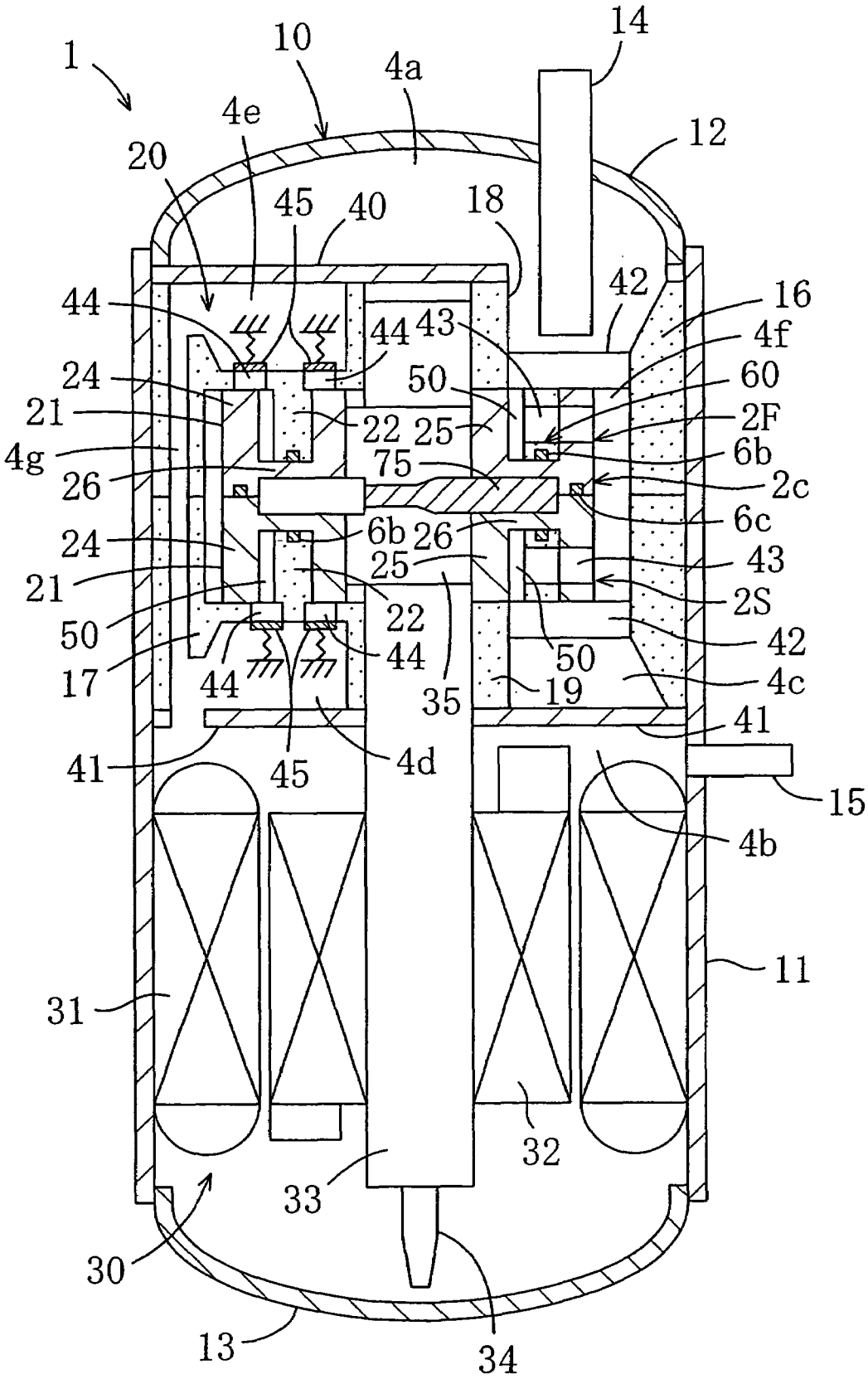
FIG. 6 is a vertical cross section of a compressor according to a fourth embodiment of the present invention.

In addition to the separation of the cylinders (21) of the first rotation mechanism (2F) and the second rotation mechanism (2S) according to the third embodiment, a balance weight (75) is provided in the present embodiment as shown in FIG. 6.

Specifically, the balance weight (75) is attached to the eccentric part (35) of the drive shaft (33). The balance weight (75) protrudes in the direction opposite to the protrusion of the eccentric part (35) and located between the end plate (26) of the cylinder (21) of the first rotation mechanism (2F) and the end plate (26) of the cylinder (21) of the second rotation mechanism (2S). Between the end plates (26) of the first and second rotation mechanisms (2F) and (2S), space is provided at the end of the balance weight (75) opposite to the direction of protrusion of the balance weight (75).

As the balance weight (75) is thus provided, imbalance due to the eccentric rotation of the cylinders (21) is eliminated.

Since the balance weight (75) is provided between the first and second rotation mechanisms (2F) and (2S), the drive shaft (33) is prevented from flexure.

Further, a seal ring (6*b*) serving as a compliance mechanism (60) is provided at the end of the piston (22). Other structural features and effects are the same as those of the third embodiment. The pressure between the end plates (26) of the first and second rotation mechanisms (2F) and (2S) are set to a low suction pressure or an intermediate pressure between the low pressure and a high discharge pressure. As a result, the refrigerant pressures exerted on the two cylinders (21) cancel out each other.

If the pressure between the end plates (26) of the first and second rotation mechanisms (2F) and (2S) is set to a high discharge pressure, the refrigerant pressures exerted on the two cylinders (21) do not cancel out each other.

Other Embodiments

The following variations may be added to the first embodiment of the present invention.

According to the present invention, the cylinder (21) may be a stationary part and the piston (22) may be a moving part. In this case, the piston (22) of the first rotation mechanism (2F) and the piston (22) of the second rotation mechanism (2S) are provided at the sides of the partition plate (2*c*), respectively.

According to the present invention, the piston (22) and the cylinder (21) of the first rotation mechanism (2F) may be a stationary part and a moving part, respectively, and the cylinder (21) and the piston (22) of the second rotation mechanism (2S) may be a stationary part and a moving part, respectively.

According to the present invention, the moving parts of the first and second rotation mechanisms (2F) and (2S) may be eccentric in the opposite direction to each other. Specifically, the first rotation mechanism (2F) and the second rotation mechanism (2S) may rotate with a 180° phase difference from each other. In this case, torque fluctuations due to volumetric difference between the outer and inner compression chambers (51) and (52) are reduced.

Alternatively, the moving parts of the first and second rotation mechanisms (2F) and (2S) may be eccentric in different directions with an angle of 90°. Specifically, the first rotation mechanism (2F) and the second rotation mechanism (2S) may rotate with a 90° phase difference from each other.

Figure 7:
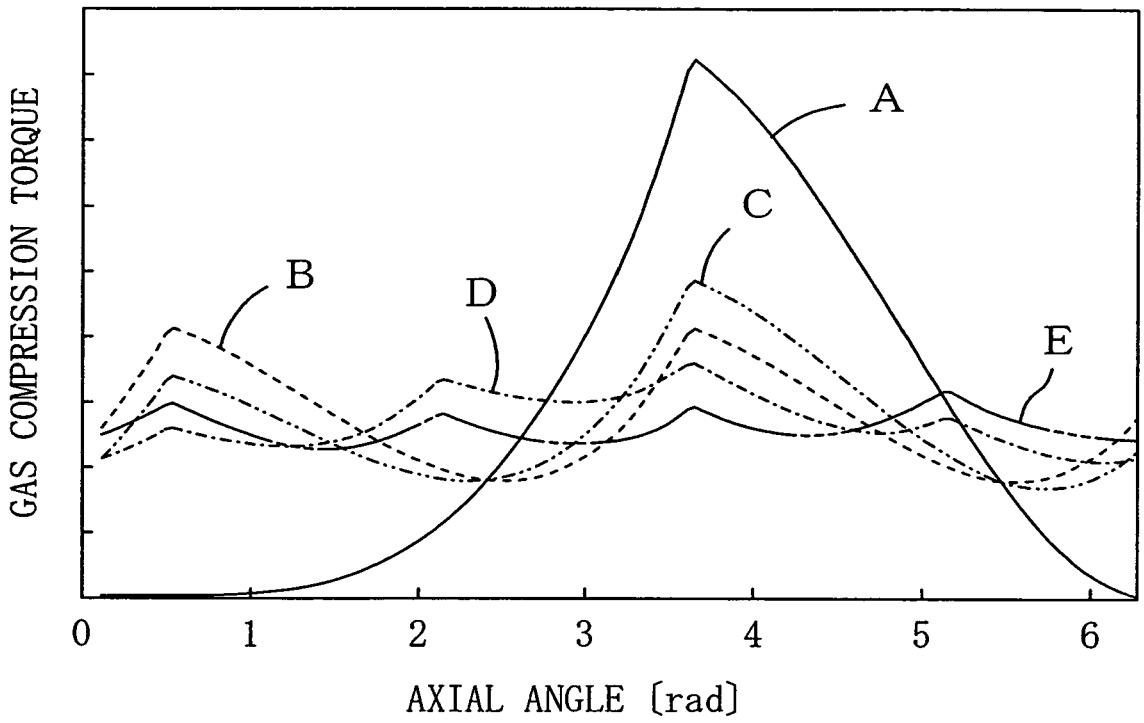
FIG. 7 is a graph illustrating torque fluctuations according to other embodiments of the present invention.

As the moving parts of the compressor (1) are eccentric, torque fluctuations occur as shown in FIG. 7. In FIG. 7, graph A indicates torque fluctuations that occurred when only the first rotation mechanism (2F) is provided and the outer compression chamber (51) only is formed therein. In this case, the torque varies significantly while the suction and discharge are carried out.

Graph B in FIG. 7 indicates torque fluctuations that occurred when the first and second rotation mechanisms (2F) and (2S) are provided, only the outer compression chambers (51) are formed therein, respectively, and the first and second rotation mechanisms (2F) and (2S) rotate with a 180° phase difference from each other. In this case, discharge occurs twice as the drive shaft (33) makes a single rotation. Therefore, the torque fluctuations are reduced as compared with the case of graph A.

Graph C in FIG. 7 indicates torque fluctuations that occurred when only the first rotation mechanism (2F) is provided and the outer and inner compression chambers (51) and (52) are formed therein. In this case, as shown in FIG. 3 according to the first embodiment, discharge occurs twice as the drive shaft (33) makes a single rotation. Therefore, the torque fluctuations are reduced as compared with the case of graph A.

Graph D in FIG. 7 indicates torque fluctuations that occurred when the first and second rotation mechanisms (2F) and (2S) are provided, the outer and inner compression chambers (51) and (52) are formed in both of them, and the first and second rotation mechanisms (2F) and (2S) rotate with a 90° phase difference from each other. In this case, the outer and inner compression chambers (51) and (52) of the first rotation mechanism (2F) have a 180° phase difference from each other, while the outer and inner compression chambers (51) and (52) of the second rotation mechanism (2S) also have a 180° phase difference from each other. In addition, as the first and second rotation mechanisms (2F) and (2S) rotate with a 90° phase difference from each other, discharge occurs four times as the drive shaft (33) makes a single rotation. Therefore, the torque fluctuations are significantly reduced as compared with the case of graph A.

Graph E in FIG. 7 indicates torque fluctuations that occurred when the first and second rotation mechanisms (2F) and (2S) are provided, the outer and inner compression chambers (51) and (52) are formed in both of them and the first and second rotation mechanisms (2F) and (2S) rotate with a 90° phase difference from each other. In addition, the positions of the vertical holes (43) serving as the suction ports are adjusted. In this case, the torque fluctuations are further reduced as compared with the case of graph D.

In the present invention, the refrigerant may be compressed in two stages. Specifically, the refrigerant is first guided into the inner compression chambers (52) of the first and second rotation mechanisms (2F) and (2S) for the first compression. At this time, the inner compression chambers (52) serve as the low-stage compression chambers. Then, the compressed refrigerant is guided to the outer compression chambers (51) of the first and second rotation mechanisms (2F) and (2S) for the second compression, and then discharged. That is, the outer compression chambers (51) are the high-stage compression chambers. In this manner, the two-stage compression may be carried out.

Further, according to the present invention, the refrigerant may be subjected to compression and expansion. First, the refrigerant is guided into the outer working chambers of the first and second rotation mechanisms (2F) and (2S) for compression. At this time, the outer working chambers serve as the compression chambers. Then, the compressed refrigerant is cooled and guided into the inner working chambers of the first and second rotation mechanisms (2F) and (2S) for expansion. At this time, the inner working chambers serve as the expansion chambers. Thereafter, the expanded refrigerant is evaporated and then guided into the outer working chambers of the first and second rotation mechanisms (2F) and (2S). Thus, these steps are repeated.

INDUSTRIAL APPLICABILITY

As described above, the present invention is useful as a rotary fluid machine including two working chambers in a cylinder chamber. In particular, the present invention is suitable for a rotary fluid machine including two rotation mechanisms.

What is claimed is:

1. A rotary fluid machine comprising:

a first rotation mechanism and a second rotation mechanism, each of which includes a cylinder having an annular cylinder chamber;

an annular piston disposed in the cylinder chamber to be eccentric to the cylinder, the annular piston dividing the cylinder chamber into an outer working chamber and an inner working chamber; and a blade arranged in the cylinder chamber to divide each of the working chambers into a high pressure region and a low pressure region, the piston and the cylinder serving as co-operating parts and any one of the piston and the cylinder being stationary and the other being rotatable about the stationary co-operating part, the first rotation mechanism and the second rotation mechanism being adjacent to each other with a partition plate sandwiched therebetween, the two moving co-operating parts or the two stationary co-operating parts of the first rotation mechanism and the second rotation mechanism being arranged such that one of the co-operating parts is provided at one side of the partition plate and the other is provided at the other side of the partition plate, and the first rotation mechanism and the second rotation mechanism being configured to rotate with a 90° phase difference from each other.

2. The rotary fluid machine according to claim 1, wherein the inner working chambers of the cylinder chambers of the first rotation mechanism and the second rotation mechanism serve as low-stage compression chambers, and the outer working chambers of the cylinder chambers of the first rotation mechanism and the second rotation mechanism serve as high-stage compression chambers.

3. The rotary fluid machine according to claim 1, wherein the outer working chambers of the cylinder chambers of the first rotation mechanism and the second rotation mechanism serve as compression chambers, and the inner working chambers of the cylinder chambers of the first rotation mechanism and the second rotation mechanism serve as expansion chambers.

4. The rotary fluid machine according to claim 1, wherein the partition plate serves as the end plates of the co-operating parts of the first rotation mechanism and the second rotation mechanism.

5. The rotary fluid machine according to claim 1, wherein the co-operating part of the first rotation mechanism and the co-operating part of the second rotation mechanism adjacent to the first rotation mechanism have individual end plates, and the partition plate is formed of the end plates of the co-operating parts of the first and second rotation mechanisms.

6. The rotary fluid machine according to claim 5, wherein the moving co-operating parts of the first and second rotation mechanisms are connected to a drive shaft, and a balance weight is provided at a part of the drive shaft located between the end plates—of the co-operating parts of the first rotation mechanism and the second rotation mechanism—adjacent to each other.

7. The rotary fluid machine according to claim 1, wherein the moving co-operating parts of the first and second rotation mechanisms are connected to a drive shaft, and each of the first rotation mechanism and the second rotation mechanism is provided with a compliance mechanism for adjusting the position of the co-operating parts in an axial direction of the drive shaft.

8. The rotary fluid machine according to claim 1, wherein the moving co-operating parts of the first and second rotation mechanisms are connected to a drive shaft, and each of the first rotation mechanism and the second rotation mechanism is provided with a compliance mechanism for adjusting the position of the co-operating parts in a direction orthogonal to an axial direction of the drive shaft.

9. The rotary fluid machine according to claim 1, wherein in each of the first and second rotation mechanisms, part of the annular piston is cut off such that the piston is C-shaped, the blade extends from the inner wall surface to the outer wall surface of the cylinder chamber and passes through the cut-off portion of the piston, and a swing bushing is provided in the cut-off portion of the piston to contact the piston and the blade via the surfaces thereof such that the blade freely reciprocates and the blade and the piston make relative swings.

10. A rotary fluid machine comprising:

a casing;

a first rotation mechanism and a second rotation mechanism, each of which includes a cylinder having an annular cylinder chamber;

an annular piston disposed in the cylinder chamber to be eccentric to the cylinder, the annular piston dividing the cylinder chamber into an outer working chamber and an inner working chamber; and a blade arranged in the cylinder chamber to divide each of the working chambers into a high pressure region and a low pressure region, the piston and the cylinder serving as co-operating parts and any one of the piston and the cylinder being stationary and the other being rotatable about the stationary co-operating part, the first rotation mechanism and the second rotation mechanism being adjacent to each other with a partition plate sandwiched therebetween and disposed between a first housing and a second housing inside of the casing, the two moving co-operating parts or the two stationary co-operating parts of the first rotation mechanism and the second rotation mechanism being arranged such that one of the co-operating parts is provided at one side of the partition plate and the other is provided at the other side of the partition plate, the two moving co-operating parts of the first and second rotation mechanisms being connected to a drive shaft, each of the first rotation mechanism and the second rotation mechanism being provided with a compliance mechanism for adjusting the position of the co-operating parts in an axial direction of the drive shaft, and the compliance mechanism being configured to secure the second housing on the casing, mount the first housing movable with respect to an axial direction of the drive shaft, and adjust a position of the co-operating parts by operating a high pressure fluid on a back surface of the movable first housing.

11. The rotary fluid machine according to claim 10, wherein the first rotation mechanism and the second rotation mechanism are configured to rotate with a 90° phase difference from each other.

12. The rotary fluid machine according to claim 10, wherein the inner working chambers of the cylinder chambers of the first rotation mechanism and the second rotation mechanism serve as low-stage compression chambers, and the outer working chambers of the cylinder chambers of the first rotation mechanism and the second rotation mechanism serve as high-stage compression chambers.

13. The rotary fluid machine according to claim 10, wherein the outer working chambers of the cylinder chambers of the first rotation mechanism and the second rotation mechanism serve as compression chambers, and the inner working chambers of the cylinder chambers of the first rotation mechanism and the second rotation mechanism serve as expansion chambers.

14. The rotary fluid machine according to claim 10, wherein the partition plate serves as the end plates of the co-operating parts of the first rotation mechanism and the second rotation mechanism.

15. The rotary fluid machine according to claim 10, wherein the co-operating part of the first rotation mechanism and the co-operating part of the second rotation mechanism adjacent to the first rotation mechanism have individual end plates, and the partition plate is formed of the end plates of the co-operating parts of the first and second rotation mechanisms.

16. The rotary fluid machine according to claim 10, wherein the moving co-operating parts of the first and second rotation mechanisms are connected to a drive shaft, and each of the first rotation mechanism and the second rotation mechanism is provided with a compliance mechanism for adjusting the position of the co-operating parts in a direction orthogonal to an axial direction of the drive shaft.

17. The rotary fluid machine according to claim 10, wherein in each of the first and second rotation mechanisms, part of the annular piston is cut off such that the piston is C-shaped, the blade extends from the inner wall surface to the outer wall surface of the cylinder chamber and passes through the cut-off portion of the piston, and a swing bushing is provided in the cut-off portion of the piston to contact the piston and the blade via the surfaces thereof such that the blade freely reciprocates and the blade and the piston make relative swings.

* * * * *